United States Patent [19]

Kozlowski

[11] 4,209,865

[45] Jul. 1, 1980

[54] WALLPAPER HAND TOOL WITH INTERCHANGEABLE BLADES

[76] Inventor: Robert L. Kozlowski, 4981 Burnley, Bloomfield Hills, Mich. 48013

[21] Appl. No.: 902,792

[22] Filed: May 4, 1978

[51] Int. Cl.[2] ..... E04F 21/28

[52] U.S. Cl. ..... 7/105; 15/104 S

[58] Field of Search ..... 7/105, 114, 158, 167; 15/104 S, 145, 236 R; 30/337, 349, 353; 81/180 D, 185

[56] References Cited

U.S. PATENT DOCUMENTS

| | | | |
|---|---|---|---|
| 1,314,044 | 8/1919 | Buker | 81/185 |
| 3,157,946 | 11/1964 | Smecko | 7/105 X |
| 4,122,570 | 10/1978 | Otken | 7/114 |

FOREIGN PATENT DOCUMENTS

| | | | |
|---|---|---|---|
| 170529 | 3/1960 | Sweden | 15/104 S |

*Primary Examiner*—James G. Smith

*Attorney, Agent, or Firm*—Hauke and Patalidis

[57] ABSTRACT

A hand tool in the form of a support plate having a handle for grasping by a person's hand and provided with a removable interchangeable working blade in the form of a three-sided frame removably mounted such as to fit over three consecutive edges of the plate. Diverse working edge frames or blades such as a felt-covered blade, a serrated blade, a squeegee blade, a brush blade, a cutting blade, and the like, are provided for interchangeable mounting on the support plate.

7 Claims, 13 Drawing Figures

WALLPAPER HAND TOOL WITH INTERCHANGEABLE BLADES

BACKGROUND OF THE INVENTION

The present invention relates to a hand tool, particularly a hand tool for applying wallpaper to a wall, and having removable interchangeable working blades each designed for effecting an appropriate task.

A plurality of hand tools are generally used for covering a wall with wallpaper. For example, a stripper may be used for removing old wallpaper or smoothing or scraping old paint from the wall, and a paste applying tool, sometimes in the form of a brush or some times in the form of a serrated blade, may be used for coating with an adhesive the back of the wallpaper or the wall surface itself. A squeegee or a roller may be used for applying pressure to the wallpaper to insure firm adhesion, without air bubbles, to the wall surface, and a knife or other cutting implement is used for cutting a section of wallpaper or trimming the edge of the wallpaper.

The present invention permits to utilize a single tool instead of a plurality of tools, the single tool of the invention being provided with a plurality of removable interchangeable edge blades each designed to accomplish a particular function. The hand tool of the invention, although more particularly useful for applying wallpaper to a wall surface, can be used for many other tasks and functions. The removable interchangeable working blades of the hand tool of the invention are in the form of a three-sided frame which can be removably slipped over the edge of a holding plate. One such particular working frame is a felt-covered frame which permits to apply the wallpaper firmly against its supporting surface without marring the surface finish of the wallpaper, another working frame consists of a cement or paste applicator, and another working frame consists of a squeegee, a brush, or any other desirable implement.

SUMMARY OF THE INVENTION

The present application accomplishes its many purposes and objects by providing a common support plate member, having a cut-out portion for the passage of the fingers of a person's hand for grasping the support plate, the edge of the support plate being provided with one of a plurality of three-sided working blades removably and interchangeably mounted on the support plate.

Further objects and advantages of the present invention will become apparent when the following description of some of the best modes contemplated for practicing the invention is read in conjunction with the accompanying drawing wherein:

DETAILED DESCRIPTION OF THE PREFERRED EMBODIMENT

Figures 1, 2, 3, 4, 5, 6, 7, 8, 9, 10, 11, 12, 13:
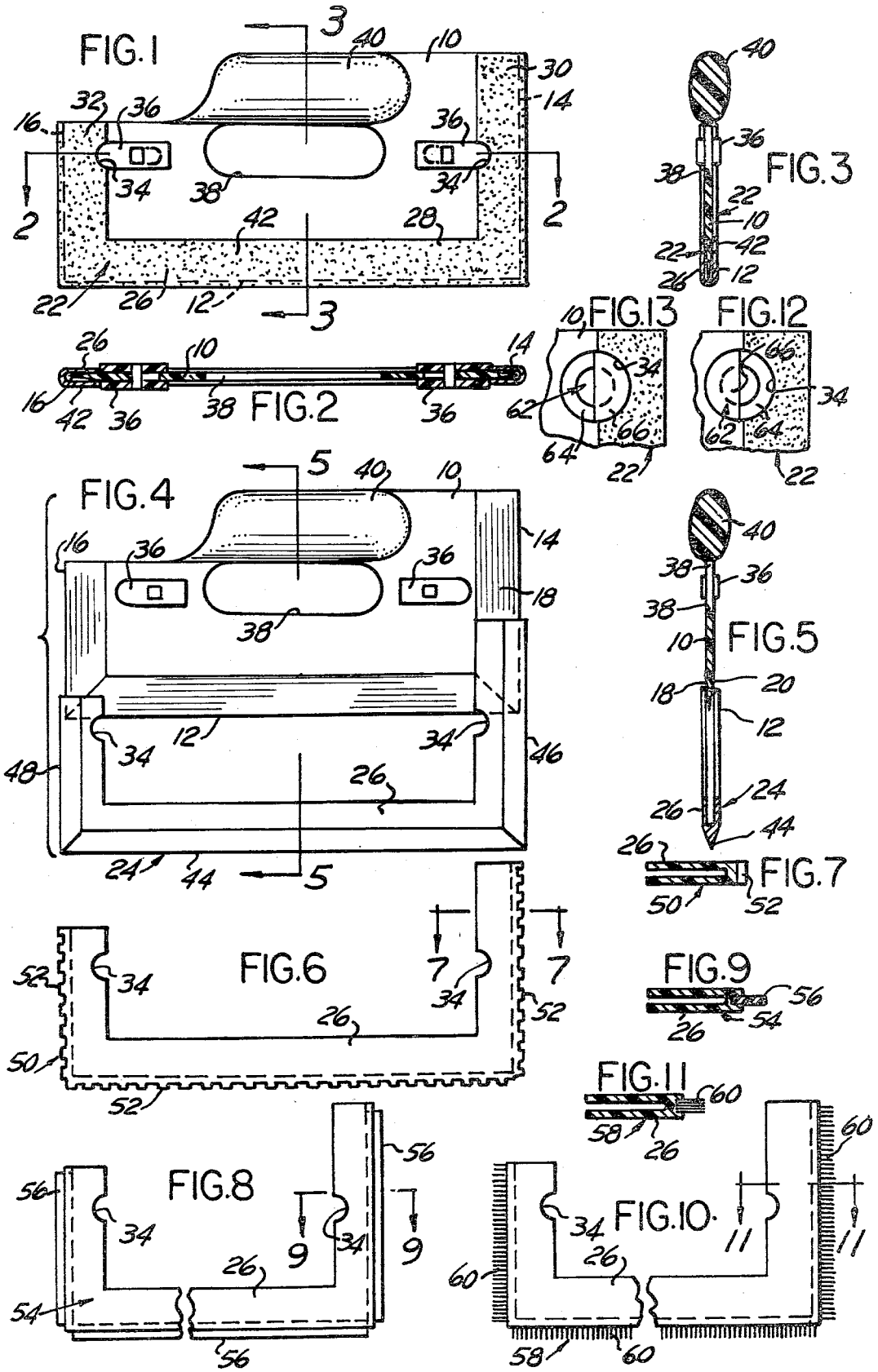
FIG. 1 is a plan elevational view of a hand tool according to the present invention provided with a removable interchangeable felt-covered working frame or blade.
FIG. 2 is a sectional view along line 2—2 of FIG. 1.
FIG. 3 is a sectional view along line 3—3 of FIG. 1.
FIG. 4 is an exploded view of the hand tool of FIG. 1 showing a working edge frame or blade partially removed therefrom.
FIG. 5 is a sectional view along line 5—5 of FIG. 4.
FIG. 6 is a plan elevational view of a modified working edge frame or blade.
FIG. 7 is a section thereof along line 7—7 of FIG. 6.
FIG. 8 is a partial plan elevation view of a modification of a working edge frame or blade.
FIG. 9 is a section along line 9—9 of FIG. 8.
FIG. 10 is a partial plan elevation view of a further modification of a working edge frame or blade.
FIG. 11 is a section along line 11—11 of FIG. 10.
FIGS. 12-13 are partial schematic views showing a modification of the structure for attaching a working edge frame or blade to the hand tool support plate of the present invention.

Referring to FIGS. 1-3, a hand tool according to the present invention comprises a support plate 10, made of steel, aluminum, or other metal, or of a substantially rigid plastic material, provided, as best shown at FIG. 4, with a relatively long bottom edge 12, a medium length side edge 14, and a short side edge 16. The side edges 14 and 16 are substantially perpendicular to the bottom edge 12, and the thickness of the plate 10 is progressively decreasing, such as to form symmetrically tapered surfaces 18 and 20, from proximate an edge to the edge itself which is, as a result, relatively sharp for the purpose of facilitating placing over the edges 12, 14 and 16 of the support plate 10 a working edge frame or blade such as the edge frame 22 of FIG. 1, or the edge frame 24 of FIG. 4.

Each edge frame 22 is generally in the form of a three-sided channel member 26, either made of a single piece or, preferably, of three pieces of metallic or plastic channel strip material of different lengths welded, cemented, or otherwise fastened together as shown. The edge frame 22 fits snugly on the three free sides of the support plate 10 provided with the edges 16, 12 and 14. The edge frame 22 has therefore a long portion 28 placed over the lower edge 12 of the support plate 10, a medium length portion 30 placed over the medium length edge 14 of the support plate 10 and a short portion 32 placed over the short edge 16 of the support plate 10. The medium length section 30 and the short length portion 32 are provided, on each side of the channel member 26, or on one side only, with a substantially semi-circular cut-out portion 34 in which is slidably disposed the end of a locking slide 36, thus holding the working edge frame 22 in position on the support plate 10. The support plate 10 has a cut-out portion 38 which, in co-operation with an increased thickness rounded portion 40 of the plate 10 provides a convenient hand grasping handle.

The working edge frame 22 of FIGS. 1-3 is provided with a felt covering 42 presenting a relatively mat, soft and smooth surface enabling the user of the hand tool of the invention to smooth out wallpaper adhesively applied to a wall surface by sliding the working edge over the surface of the wallpaper without any risk of scratching, marring or creasing a surface that could be easily damaged such as is the case for foil or metallized wallpaper. As the working edge is relatively rigid and applies pressure on a relatively small area of the wallpaper, considerable pressure may be applied, thus expelling any air that may be trapped between the wall surface and the back surface of the wallpaper, and progressively pushing air bubbles to the edge of the wallpaper where the air can escape, without requiring pin holes to be made through the wallpaper to eliminate the air bubbles.

When it is desired to remove the working edge frame 22, when worn for example for replacing by a new working edge frame or, in the alternative, for substituting a different working edge frame, the slides 36 are manually slid back until their respective tip no longer engages the recess 34 in the edge frame, and the working edge frame 22 is slipped off the holder plate 10. A new or different working edge frame may thus be placed over the holder plate 10, as illustrated for example at FIGS. 4–5 showing a working edge frame 24 being placed over the holder plate 10. The working edge frame 24 is structurally similar to the working edge frame 22 of FIGS. 1–3, but is made of relatively hard steel having a long sharp cutting edge 44, a medium length sharp cutting edge 46 and a relatively short sharp cutting edge 48. The working edge frame 24 may be used as a knife for cleanly cutting wallpaper, or for any other operation where a cutting sharp edge is useful.

Examples of different working edge frames are illustrated at FIGS. 6–11. FIGS. 6–7 illustrate an example of working edge frame 50 provided on its three sides with a serrated edge 52. Such serrated edge 52 provides a convenient applicator for cement or paste, for applying adhesive to a wall or to the back of wallpaper or for applying adhesive to a wall or floor for fastening tiles or linoleum. Especially if made of a plastic material, as illustrated, the serrated working edge frame 50 makes a convenient ice scraper or the like.

FIGS. 8–9 illustrate an example of removable edge frame member 54 forming a squeegee by being provided at its edge with an elastomeric blade 56 in a long section mounted at the bottom of the edge frame member, and two other shorter sections each mounted at one of the short sides.

FIGS. 10–11 illustrate another example of a removable working edge frame member 58 in the form of a brush consisting of a plurality of bristles 60 fastened to at least the lower edge of the frame member.

It will be appreciated that by providing the holder plate 10 and the removable interchangeable working frames or blades with three sides of unequal lengths, three working edges of unequal length are at all times available permitting the user of the hand tool of the invention to work on a large area or on small areas, as desired, such various length working edges being at all times available on a single tool.

It will also be readily appreciated by those skilled in the art that other means than the locking slide 36 may be used for holding the removable interchangeable working edge frames or blades on the holding plate 10. An example of an alternate arrangement is illustrated at FIGS. 12–13, consisting of a rotatable finger-operable pin 62, having a portion 64 flush with the surface of the plate 10 and a projecting portion 66 engageable, upon rotation of the pin 62 into the frame recess 34, from the locked position illustrated at FIG. 13 to the unlocked position illustrated at FIG. 12.

Having thus described the present invention by way of a structural embodiment, modifications whereof will be apparent to those skilled in the art, what is claimed as new is as follows:

1. A hand tool consisting of a holder plate and a plurality of interchangeable removable working edge frames, said holder plate comprising a handle and a peripheral portion provided with at least one straight edge and each of said working edge frames comprising a channel member removably fitted over said straight edge of said holder plate, and said holder plate and each of said working edge frames having co-operating complementary means for removably holding and locking one of said working edge frames on said holder plate peripheral portion wherein each of said working edge frames comprises three integral channel members for mounting over three peripheral consecutive edges of said holder plate as a unit.

2. The hand tool of claim 1 wherein one of said working edge frames is a felt-covered channel member.

3. The hand tool of claim 1 wherein one of said working edge frames is a channel member with a sharp cutting edge.

4. The hand tool of claim 1 wherein one of said working edge frames has a serrated edge structure.

5. The hand tool of claim 1 wherein one of said working edge frames is provided at its edge with an elastomeric elongated member.

6. The hand tool of claim 1 wherein one of said working edge frames is provided at its edge with brush bristles.

7. The hand tool of claim 1 wherein said integral channel members are of different lengths.

* * * * *